US006176287B1

(12) United States Patent
Weber

(10) Patent No.: US 6,176,287 B1
(45) Date of Patent: Jan. 23, 2001

(54) APPARATUS FOR MECHANICALLY PROCESSING PAPER AND HAVING IMPROVED ROLLER SUPPORTS AND METHOD FOR REPLACING SUCH ROLLERS

(75) Inventor: Manfred Weber, Richtolsheim (FR)

(73) Assignee: Fort James France, Kunheim (FR)

( * ) Notice: Under 35 U.S.C. 154(b), the term of this patent shall be extended for 0 days.

(21) Appl. No.: 09/228,657

(22) Filed: Jan. 12, 1999

(30) Foreign Application Priority Data

Jan. 12, 1998 (FR) ..... 98 00211

(51) Int. Cl.[7] ..... B31F 5/00

(52) U.S. Cl. ..... 156/555; 29/402.03; 156/582; 162/272

(58) Field of Search ..... 29/402.03, 426.1, 29/700, 724; 162/232, 272; 384/500; 131/60; 156/582, 555, 209, 219, 220

(56) References Cited

U.S. PATENT DOCUMENTS 5,234,271 * 8/1993 Linstrom ..... 384/510

* cited by examiner

*Primary Examiner*—S. Thomas Hughes
*Assistant Examiner*—John C. Hong
(74) *Attorney, Agent, or Firm*—Breiner & Breiner

(57) ABSTRACT

The invention concerns an apparatus for mechanically treating paper and includes two engraved cylinders each mounted between two support plates of the apparatus in a mutually tangential manner by means of cylindrical bearings affixed in corresponding housings fitted into the support plates, a first roller of the engraved rollers being mounted on a cradle pivoting relative to a stationary base plate on which is mounted the second engraved roller, the invention being characterized in that the cylindrical bearings are affixed in housings bounded at least in part by a detachable bracket which, when detached, frees a radial aperture through which the cylindrical bearing can be removed along a radial direction.

3 Claims, 6 Drawing Sheets

APPARATUS FOR MECHANICALLY PROCESSING PAPER AND HAVING IMPROVED ROLLER SUPPORTS AND METHOD FOR REPLACING SUCH ROLLERS

FIELD OF INVENTION

The invention relates to an apparatus for mechanically processing paper, hereafter called mechanical paper processing apparatus, in particular for embossing and joining two continuous strips of absorbent paper such as cellulose wadding, which apparatus is fitted with improved roller supports, and to a method for replacing the rollers of such an apparatus.

BACKGROUND OF THE INVENTION

More specifically, the invention concerns a mechanical paper processing apparatus, two paper strips each passing between two cylindrical embossing rollers, one roller being smooth and rubber-clad, the other being engraved and illustratively made of steel. The axes of the two engraved rollers run parallel and each roller is mounted rotatably about its axis between two support plates of the apparatus and both rollers configured tangentially to each other. In this apparatus design, a first of the engraved rollers is rotatably mounted on a cradle which is pivotable relative to a stationary apparatus base plate, the second engraved roller being mounted on this base plate, and furthermore each engraved roller is mounted in rotatable manner by means of cylindrical bearings at each roller end which are affixed in corresponding housings in the support plates respectively of the stationary base plate and of the pivoting cradle.

FIG. 1 illustrates a portion of a known apparatus for processing paper mechanically. It includes two engraved cylindrical rollers each mounted rotatably about a horizontal transverse axis between two vertical apparatus support plates each running in a plane perpendicular to the roller axes. Each roller includes a central shaft of which one end is mounted by means of a cylindrical bearing into a housing of the corresponding support plate. Illustratively, the cylindrical bearing may act simultaneously as a rotational roller guide and as a roller affixation means in the transverse direction. The cylindrical bearing furthermore may include means driving the roller into rotation and/or means accurately adjusting the roller axis position, in particular, to control the separation of the two engraved rollers or their relative axial positions.

When the engraved rollers must be replaced, for example for maintenance or to be exchanged for rollers offering a different embossing pattern, implementation will be time consuming and tricky.

The old roller(s) must be dismantled and thereby the cylindrical bearings must be removed. The reassembly of the cylindrical bearings and the replacement roller(s) is time consuming and laborious because of the many necessary adjustments.

OBJECT AND BRIEF DESCRIPTION OF THE INVENTION

The objective of the invention is a new apparatus design to mechanically process paper allowing exchange of the engraved rollers more rapidly, in particular to lessen the time for such a replacement during which, necessarily, machine output has stopped.

For that purpose, the invention involves the above apparatus which is characterized in that the cylindrical bearings of at least one of the engraved rollers are affixed into housings which are bounded at least in part by a detachable bracket that, in the detached state, frees a radial aperture through which the cylindrical bearings can be radially removed from the housing.

Other features of the invention are the following:

- the radial housing aperture runs across the full thickness of the support plates in the transverse direction of the roller axes,
- the two engraved rollers are fitted with cylindrical bearings affixed in housings partly bounded by detachable brackets,
- the cradle supporting one of the engraved rollers pivots about a transverse axis parallel to the roller axes between an operational position wherein the two rollers are tangent to each other and a free position allowing disassembly of the engraved rollers, the support plates 14, 16 of the cradle and of the base plate being configured substantially in one plane which runs perpendicularly to the transverse roller axes, and, once the brackets are detached, the apertures of the housings of the support plates on the base plate and of the cradle will radially face one another,
- for the operational cradle position, each of the cradle support plates is substantially juxtaposed with a base plate support plate and their housing apertures each are fitted with a guide edge present as an extension of a guide edge of the aperture of the juxtaposed support plate,
- a drive means is affixed on one side to the stationary base plate and on the other side to a cradle support plate, this drive means assuring pivoting of the cradle relative to the stationary base plate between the operational and the free positions.

Furthermore, the invention relates to a method for replacing the engraved rollers of a mechanical paper processing apparatus and including any one of the above features, the method being characterized by inclusion of the following stages:

- pivoting the cradle toward its free position,
- detaching the brackets from the vertical cradle plates 14,
- removing the first engraved roller by radially withdrawing its cylindrical bearings through their housing apertures in the support plates,
- detaching the brackets from the vertical support plates,
- moving the cradle back into its operational position,
- removing the second engraved roller by radially withdrawing its cylindrical bearings through their housing apertures in the support plates.

The method of the invention includes further features, namely:

- in order to remove the second roller, it is radially withdrawn by moving each of its cylindrical bearings from the housing of the vertical support plate on the base plate to the vertical support plate of the cradle along the mutually opposite guide edges of the apertures, the cradle being moved a second time toward the free position to allow removal of the second engraved roller,
- the engraved replacement rollers are fitted with their own cylindrical bearings.

Other features and advantages of the invention are elucidated in the following description and in relation to the attached drawings.

DESCRIPTION OF PRESENTLY PREFERRED EMBODIMENTS

Figure 1:
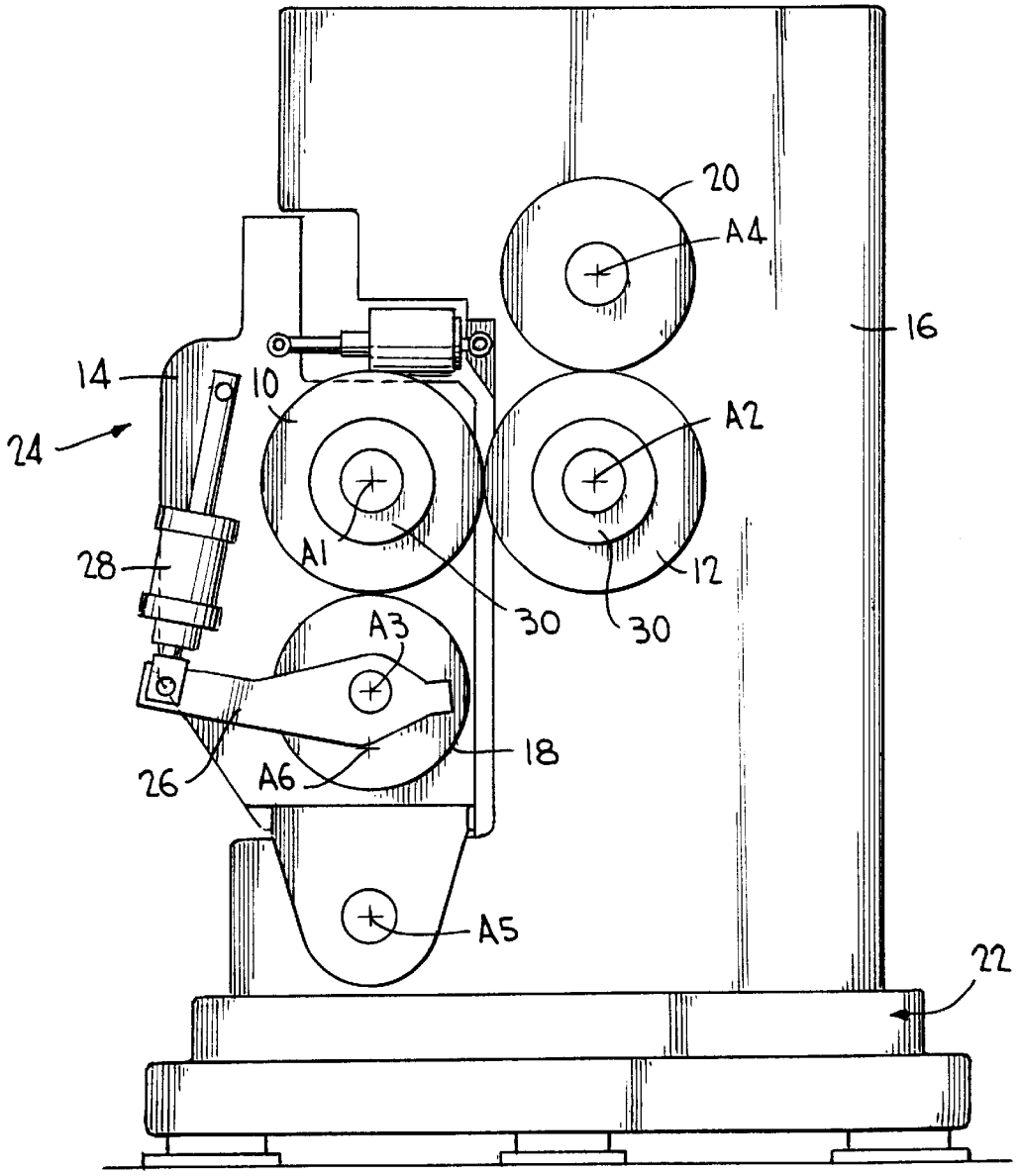
FIG. 1 (PRIOR ART)
FIG. 1 is a schematic side view of part of the mechanical paper processing apparatus of the prior art.

FIG. 1 schematically shows a portion of a mechanical paper processing apparatus, in particular a part of the apparatus used for embossing and for joining two strips of paper passing between two engraved cylindrical rollers 10, 12 each mounted to rotate about an axis A1 and A2, respectively, between two support plates 14, 16 configured in planes perpendicular to the axis A1, A2 at the two axial ends of the rollers 10, 12.

In the illustrative embodiment of the Figures, the two axes A1, A2 are configured in one horizontal plane and the plates 14, 16 are substantially vertical.

Furthermore, the apparatus includes rubber-clad rollers 18, 20 allowing pressing of the paper strip against the engraved rollers 10, 12. These rubber-clad rollers also are mounted to be rotatable about two transverse horizontal axes A3, A4 and are respectively configured below and above their associated engraved roller 10, 12.

The first roller 10 of the engraved rollers and the associated rubber-clad roller 18 are mounted in a conventional manner on support plates 14 hinged about a transverse horizontal axis A5 relative to an apparatus base plate 22 to allow disengagement of the first roller 10 from the second roller 12.

In this manner, the two movable support plates 14 supporting the first roller 10 constitute a cradle 24 pivotable about the axis A5 relative to the apparatus base plate 22 from an operational position (shown in FIG. 1) to a disengaged position.

On the other hand, the stationary support plates 16 supporting the second roller 12 of the engraved rollers are rigidly affixed to the base plate 22 of which they are an integral part.

As shown by FIG. 1, the rubber-clad roller 18 associated with the first roller 10 is not mounted directly on the cradle 24 to which it is linked by two arms 26 which in turn are pivotable relative to the support plates 14 about a horizontal transverse axis A6 between an operational position shown in FIG. 1 and a retracted position wherein the rubber-clad roller 18 no longer makes contact with the first engraved roller 10. Each arm 26 is driven by a jack 28 to pivot about its axis A6.

As schematically shown in FIG. 1, each of the two engraved rollers 10, 12 is mounted between two corresponding support plates 14, 16 by means of cylindrical bearings 30, illustratively, implementing rotational guidance, axial affixation, rotation and/or accurate relative positioning of each roller 10, 12 relative to the respective support plates 14, 16.

The cylindrical bearings 30 are received in corresponding housings in the support plates 14, 16.

Figure 2:
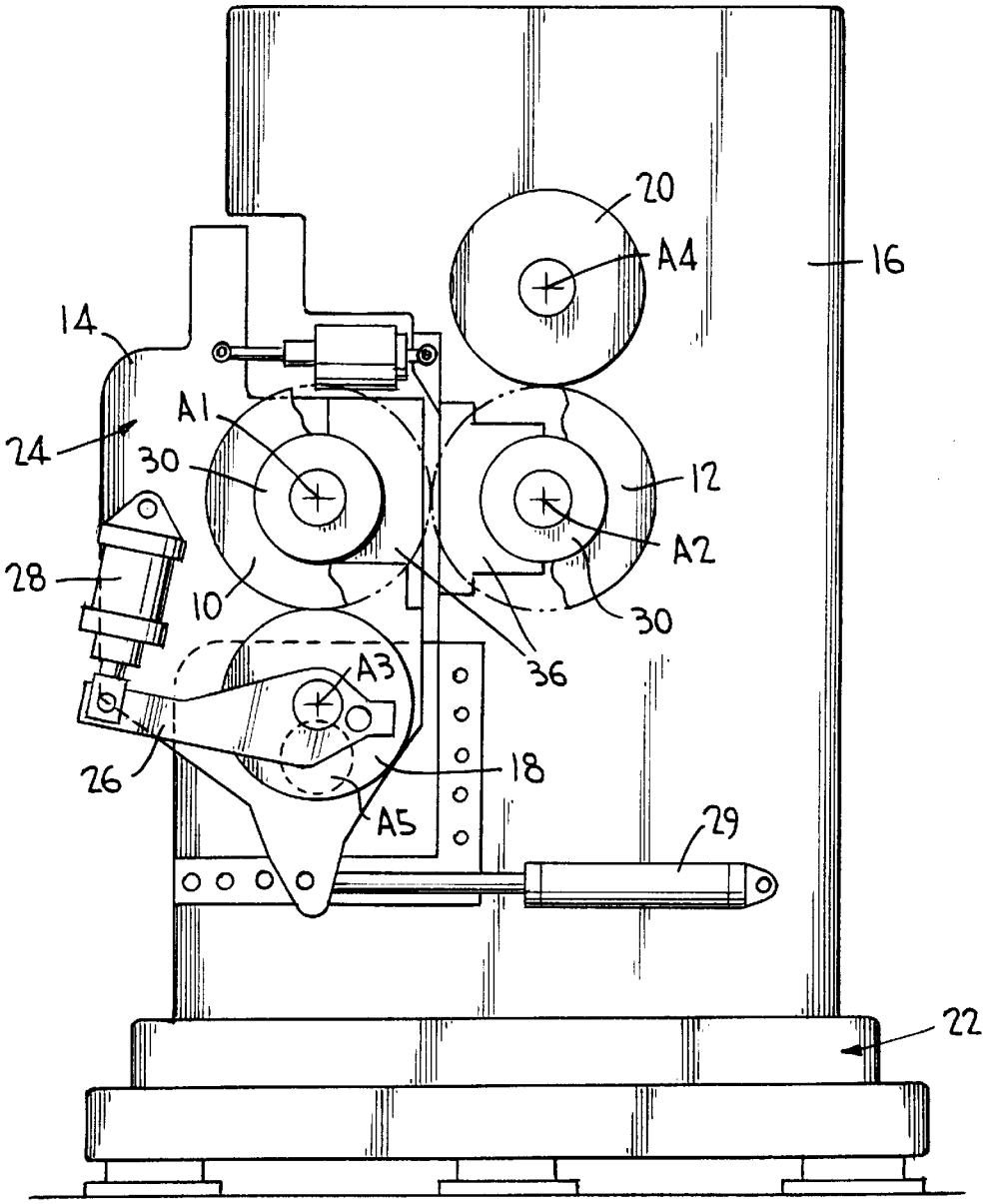
FIG. 2 is a view similar to that of FIG. 1 illustrating a mechanical paper processing apparatus of the invention.

FIG. 2 illustrates a mechanical processing paper apparatus of the invention.

As shown in FIG. 2, the position of the pivot axis A5 of the cradle 24 has been modified to allow a larger opening angle of cradle 24 toward its disengaged position. Accordingly, the pivot axis A5 was moved closer to the axis A1 of the first engraved roller 10 supported by the cradle 24. For that purpose and in the illustration shown, the support plates 16 linked to the base plate 22 were modified by the addition of a fixed base plate.

The pivot axis A5 of the cradle 24 is configured substantially in a vertical plane passing through the axis A1 of the first roller 10 and below the latter.

A drive jack 29 is mounted between the cradle and the stationary base plate. This jack pivots the cradle between the operational and disengaged positions.

The support plates 14, 16 furthermore are modified in this embodiment in such a manner that the housings receiving the cylindrical bearings supporting each of the engraved rollers 10, 12 are partly bounded by detachable brackets 36.

Figure 3:
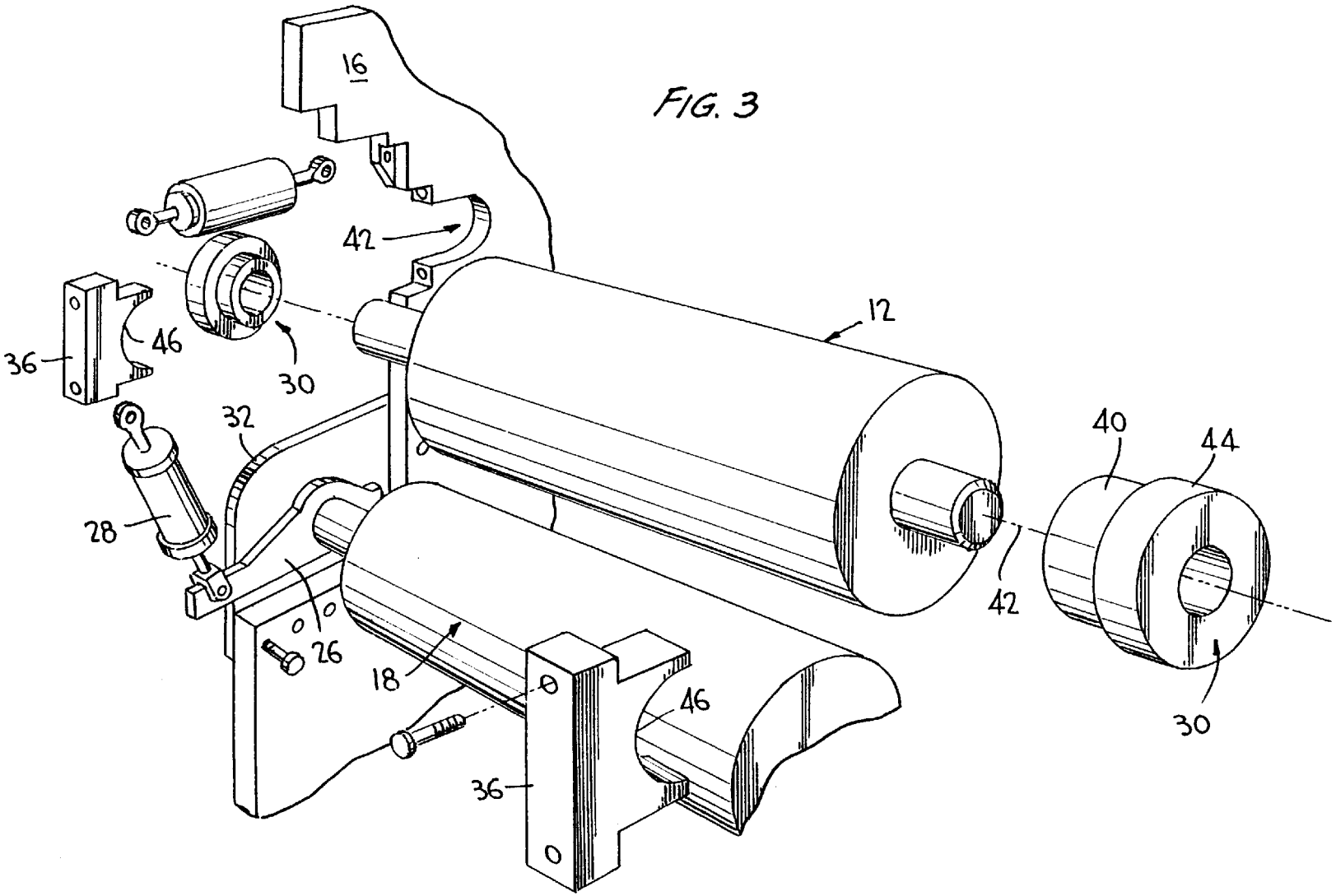
FIG. 3 is an exploded perspective showing the assembly of an engraved roller of the invention.

As shown in FIG. 3, a cylindrical bearing 30 constitutes an assembly axially crossed by the axial ends of a central shaft of each of the two rollers 10, 12. At least a portion 40 of the bearings 30 engages a housing 42 in the edge of the support plate while a second portion 44 of the bearing 30 illustratively can transversely project outside the support plate being considered.

In the embodiment shown in the Figures, the portion 40 of a cylindrical bearing 30 received in the housing 42 is cylindrical and the housing 42 assumes a complementary cylindrical shape. Half of this cylinder is bounded in the corresponding edge of the support plate whereas the other cylinder half is bounded by a semi-cylindrical arced surface 46 of the corresponding detachable bracket 36.

In an illustrative manner, the plane of connection of the two semi-cylindrical arced surfaces that bound the housing 42 is vertical, whereby, in such a design, the transverse bracket can be radially disassembled in a substantially horizontal direction relative to the axis A1, A2 of the particular roller 10, 12.

After the bracket 36 has been removed, the housing 42 thereby will include a radial aperture running transversely across the full thickness of the supporting plate and the cylindrical bearing 30 can be radially engaged into or disengaged from this aperture.

In the embodiment of the invention shown in the Figures, the two engraved rollers 10, 12 therefore are assembled to allow radial disassembly by their cylindrical bearings 30 due to the detachable brackets 36. However, only one of the two rollers can be fitted with such detachable brackets 36.

The invention eliminates the need to separately disassemble the bearings 30 and the roller, and roller removal is made much easier thereby.

Figure 4:
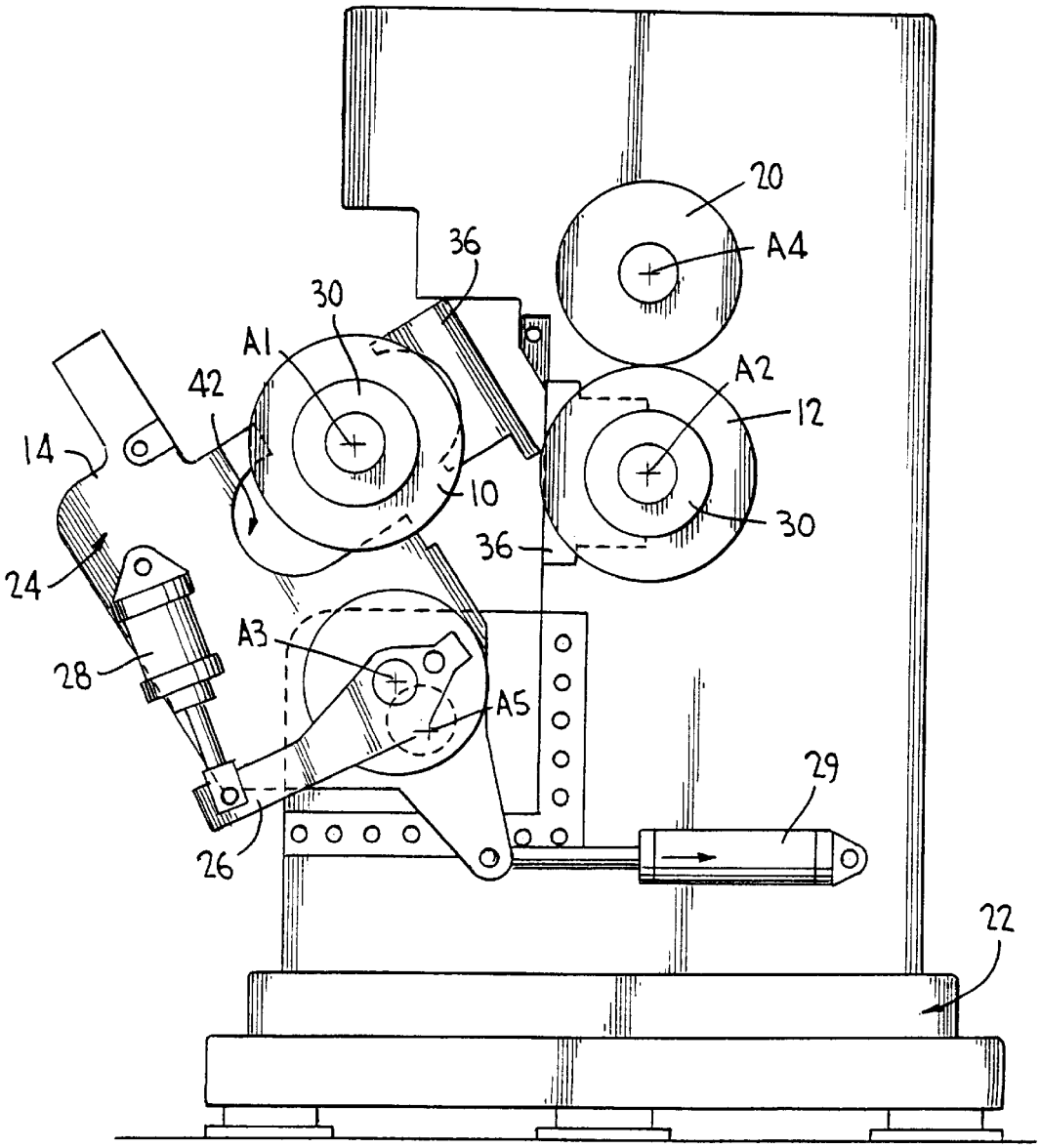
FIGS. 4–6 are views similar to FIG. 2 showing the roller replacement stages for the mechanical paper processing apparatus of the invention.
Figure 5:
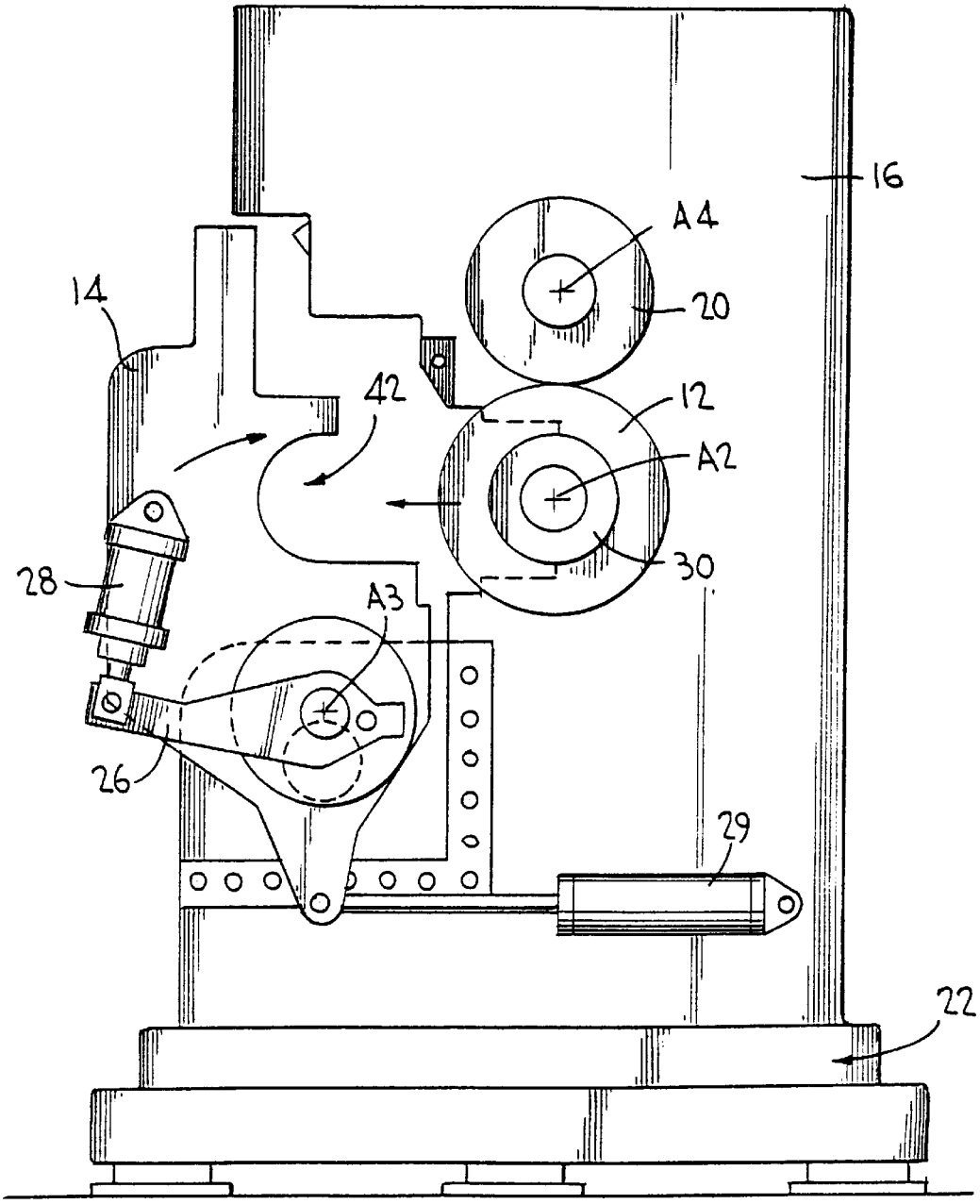
Figure 6:
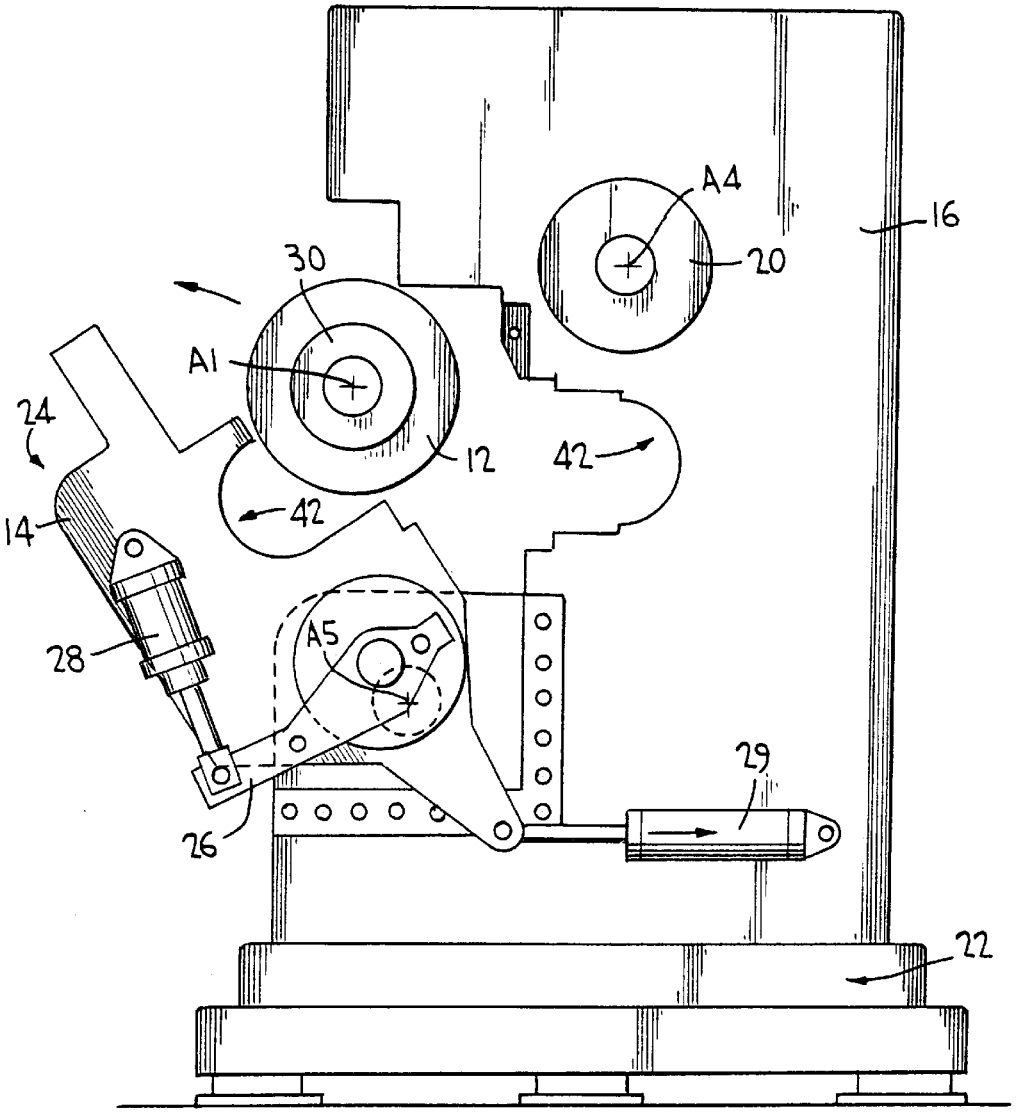

FIGS. 4 through 6 show different stages in the replacement of the cylinders 10, 12 of an apparatus of the invention.

In the stage shown in FIG. 4, the jacks 28 are decompressed and the jack 29 is driven to pivot the cradle about its axis A5.

Thereupon, the brackets 36 holding the cylindrical bearings 30 of the first engraved roller 10 against the cradle 24 can be detached and thus the roller 10 can be radially removed out of the housing 42 in the movable support plates 14.

In the stage of FIG. 5, the brackets 36 having been detached from the stationary support plates 16, and the cradle 24 is returned by jacks 29 to its operational position in such a manner that the housing 42 of the cradle 24 is opposite the second roller 12.

Once the brackets 36 have been detached, the housings 42 designed to receive the cylindrical bearings 30 in each of the support plates 14, 16 assume a shape such that when the cradle 24 is in the operational position, they will radially face each other. The aperture of each housing 42 normally is blocked by the bracket 36 and in particular is fitted with a guide edge. The guide edges of the apertures of two mutually opposite housings are configured substantially to be parallel in the extension of one another when the brackets 36 have been detached. Where called for, a movable part forming a bridge between the two edges may be provided.

Consequently, the cradle 24 having previously been returned to its operational position as shown in FIG. 5, the second roller 12 together with its cylindrical bearings 30 can be horizontally moved toward the housings 42 in the movable support plates 14 of the cradle 24. Therefore, as shown in FIG. 6, by subsequently displacing the cradle 24 into its disengaged position, the second roller 12 together with its cylindrical bearings 30 can be easily handled when removing them from the machine.

Clearly replacement rollers are mounted in the reverse order.

Thanks to the invention, the replacement rollers can be fitted with their cylindrical bearings before undertaking the actual replacement, that is without such a fitting procedure lengthening the apparatus shutdown and hence outage of operation.

This especially susceptible stage can therefore be carried out when the apparatus is operating.

Moreover, the invention allows easy retrofitting of existing machinery of the model as shown in FIG. 1.

What is claimed is:

1. A mechanical paper processing apparatus comprising a first engraved cylindrical roller and a second engraved cylindrical roller between which a strip of paper can pass, said first engraved roller having a transverse axis which is parallel to a transverse axis of said second engraved roller, with each engraved roller being mounted to rotate about its axis between a pair of first support plates and a pair of second support plates of the apparatus, said first engraved roller and said second engraved roller being tangential to each other, said first engraved roller being rotatably mounted on a cradle, including said first support plates, which is pivotal relative to a base plate on which the second engraved roller is mounted, wherein each of said first engraved roller and said second engraved roller is rotatably mounted by means of cylindrical bearings present at each end of each of said first engraved roller and said second engraved roller and said cylindrical bearings being held inside corresponding housings present in the first support plates and the second support plates, wherein the cylindrical bearings of each one of the first engraved roller and the second engraved roller are affixed in the housings and are at least partially bounded by a detachable bracket which, when detached, frees a radial aperture in a housing through which a cylindrical bearing present in relation thereto can be removed from the housing along a radial direction, wherein the radial aperture of each housing extends across a thickness of a corresponding support plate in a transverse direction corresponding to axes of the first engraved roller and the second engraved roller; wherein the first engraved roller and the second engraved roller are each fitted with cylindrical bearings affixed in housings partially bounded by detachable brackets; and wherein the cradle holding the first engraved roller pivots about a transverse axis parallel to the axes of the first engraved roller and the second engraved roller between an operational position wherein the first engraved roller and the second engraved roller are substantially tangent to each other, and a free position from which to disassemble the first engraved roller and the second engraved roller, wherein the first support plates and the second support plates are substantially configured in one plane which is perpendicular to the axes of the first engraved roller and the second roller and wherein upon detachment of the bracket, an aperture of each housing of the first support plates radially faces an aperture of an opposite housing in the second support plates.

2. Mechanical paper processing apparatus as claimed in claim 1, wherein when the cradle is in an operational position, each support plate of the cradle is substantially juxtaposed with a support plate connected to the base plate, and each aperture of each housing of a support plate of the cradle is fitted with a guide edge configured as an extension of a guide edge of each aperture of a support plate of the base plate juxtaposed thereto.

3. Mechanical paper processing apparatus as claimed in claim 1 further comprising a drive jack between the cradle and the base plate to control pivoting of the cradle.

* * * * *